US006109308A

United States Patent [19]

Yoneda et al.

[11] Patent Number: 6,109,308

[45] Date of Patent: Aug. 29, 2000

[54] FRINGED SELVAGE RETAINER OPERATING DEVICE

[75] Inventors: Hidetomo Yoneda; Yutaka Uragaki; Manabu Kaida; Hideki Banba, all of Kanazawa, Japan

[73] Assignee: Tsudakoma Kogyo Kabushiki Kaisha, Ishikawa-Ken, Japan

[21] Appl. No.: 09/312,603

[22] Filed: May 17, 1999

[30] Foreign Application Priority Data

May 18, 1998 [JP] Japan ..... 10-153607

[51] Int. Cl.[7] ..... D03D 47/40

[52] U.S. Cl. ..... 139/302; 139/116.1

[58] Field of Search ..... 139/302, 116.1

[56] References Cited

U.S. PATENT DOCUMENTS

| | | | |
|---|---|---|---|
| 4,520,850 | 6/1985 | Cramer et al. | 139/194 |
| 4,749,006 | 6/1988 | Miyamoto | 139/1 R |
| 5,224,521 | 7/1993 | De Jager | 139/194 |

FOREIGN PATENT DOCUMENTS

| | | |
|---|---|---|
| 0 322 576 | 7/1989 | European Pat. Off. . |
| 0 332 258 | 9/1989 | European Pat. Off. . |
| 0 575 990 | 12/1993 | European Pat. Off. . |
| 2 634 230 | 1/1990 | France . |
| 60-14137 | 4/1985 | Japan . |
| 6-27399 | 4/1994 | Japan . |
| 7-122199 | 12/1995 | Japan . |
| 3041518 | 7/1997 | Japan . |
| 10-325051 | 12/1998 | Japan . |

*Primary Examiner*—Andy Falik

*Attorney, Agent, or Firm*—Wenderoth, Lind & Ponack, L.L.P.

[57] ABSTRACT

A fringed selvage retainer operating device is incorporated into a shuttleless loom to operate a fringed selvage retainer for preventing the folding of free ends of weft yarns which form a fringed selvage of a fabric on the shuttleless loom on an arriving side of the shuttleless loom. The operating device also shifts the fringed selvage retainer between a working position where the fringed selvage retainer is placed during a weaving operation and a waiting position where the fringed selvage retainer is placed during a faulty weft yam extracting operation by an actuator. The fringed selvage retainer is separated from the fringed selvage and shifted to the waiting position so that a faulty weft yarn may not twine around or may not be caught by the fringed selvage retainer when extracting the faulty weft yarn from a shed formed by reversing the shuttleless loom.

4 Claims, 4 Drawing Sheets

FRINGED SELVAGE RETAINER OPERATING DEVICE

BACKGROUND OF THE INVENTION

1. Field of the Invention

The present invention relates to a device for preventing the folding of free ends of picked weft yarns forming a fringed selvage by a fringed selvage retainer during the weaving operation of a shuttleless loom, and for moving the fringed selvage retainer to a waiting position to prevent a faultily picked weft yarn from twining around or being caught by the fringed selvage retainer when extracting the faultily picked weft yarn from a shed.

2. Description of the Related Art

A similar technique for preventing the folding of free ends of weft yarns extending on an arriving side of a loom opposite a picking side, i.e., a side on the side of a picking nozzle, is proposed in Japanese Utility Model No. 3041518. This prior art technique disposes a catching member on the outer side of catch cords on an arriving side of a loom, and uses a beating-up motion to bring a free end part of a picked weft yarn into engagement with a curved projection formed in one end of the catching member to prevent the free end part of the picked weft yarn on the arriving side of the loom from folding back. This prior art technique prevents the folding of the free end parts of the picked weft yarns, i.e., end parts forming a fringed selvage, on the arriving side. However, when extracting a faultily picked weft yarn from a shed by pulling the same from the arriving side, the faultily picked weft yarn twines around or is caught by the catching member. Thus, the folding of the fringed selvage is prevented, and the faultily picked weft yarn cannot be extracted.

SUMMARY OF THE INVENTION

Accordingly, it is an object of the present invention to prevent the folding of free ends of weft yarns normally picked by a weaving operation of a shuttleless loom so as to form a fringed selvage on an arriving side of the shuttleless loom. It is also an object to extract a faultily picked weft yarn surely from the arriving side opposite a picking side.

The present invention is intended for application to a shuttleless loom (1). The shuttleless loom (1) has a fringed selvage retainer (12) disposed between a far edge of a fabric (9) on the shuttleless loom (1) on an arriving side, and a faulty weft yarn extracting device (14) disposed at a position on the arriving side to extract a faultily picked weft yarn **(3*a*) from the fabric (9). The loom (1) holds free end parts of picked weft yarns (3) so as to form a fringed selvage (10) by using a holding part (13) of the fringed selvage retainer (12) to prevent the free end parts of the weft yarns (3) that form the fringed selvage (10) from folding back. The shuttleless loom (1) also pulls the faultily picked weft yarn (3*a*) by using the faulty weft yarn extracting device (14) to extract the faulty weft yarn (3*a*) from a shed (6) formed by warp yarns (5)**.

According to one aspect of the present invention, a fringed selvage retainer operating device (2) comprises an actuator (16) connected to the fringed selvage retainer (12) of the shuttleless loom (1) to shift the fringed selvage retainer (12) between a working position where the fringed selvage retainer (12) is placed during a weaving operation, and a waiting position where the fringed selvage retainer (12) is placed during a weft yarn extracting operation for extracting a faultily picked weft yarn **(3*a*). The retainer operating device also comprises a controller (17) for controlling the actuator (16) so as to make the actuator (16) shift the fringed selvage retainer (12) to the waiting position at least while the faultily picked weft yarn (3*a*) is being pulled by the faulty weft yarn extracting device (14) after the shuttleless loom (1)** has been stopped.

While the shuttleless loom (1) is in the weaving operation, the fringed selvage retainer (12) is placed at the working position and holds free end parts of picked weft yarns (3) which form the fringed selvage (10) by using the holding part (13) to prevent the fringed selvage (10) from folding back. When a mispick occurs or when a mispick is expected because of a defective weft yarn, the fringed selvage retainer (12) is shifted to the waiting position by the cooperative action of the actuator (16) and the controller (17). When the fringed selvage retainer (12) is shifted to the waiting position, the fringed selvage retainer (12) will not interfere with the faulty weft yarn extracting operation of the faultily picked weft yarn extracting device (14), which extracts the faultily picked weft yarn **(3*a*). Consequently, the faulty weft yarn extracting device (14) is able to smoothly extract the faultily picked weft yarn (3*a*) from the shed (6) formed by the warp yarns (5). In the following description, the term, "faulty weft yarn" signifies both a faultily picked weft yarn (3*a*) and a weft yarn (3)** having a defect, such as an excessively large knot.

According to the present invention, the fringed selvage retainer is shifted between the working position and the waiting position. The fringed selvage retainer is placed at the working position during a normal weaving operation to prevent the fringed selvage on the arriving side from folding back, and the fringed selvage retainer is placed at the waiting position during a faulty weft yarn extracting operation to prevent the fringed selvage retainer from interfering with the faulty weft yarn so that the faulty weft yarn can be extracted.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
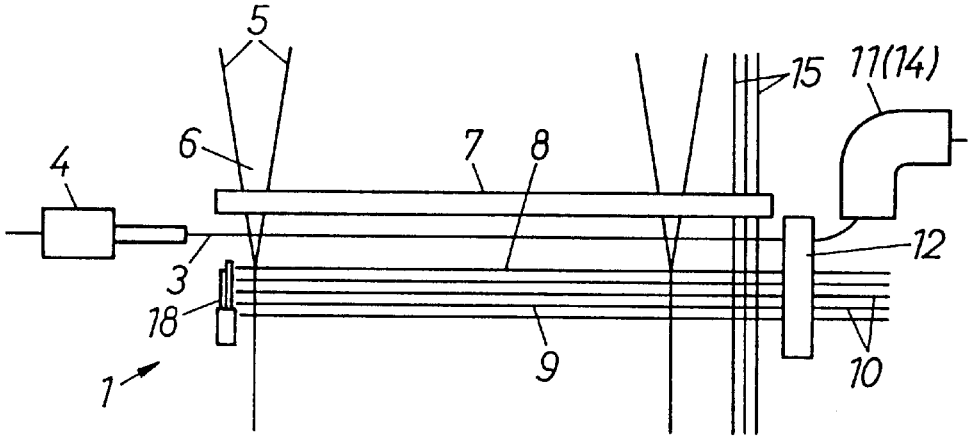
FIG. 1 is a schematic plan view of an essential part of a shuttleless loom provided with a fringed selvage retainer.
Figure 2:
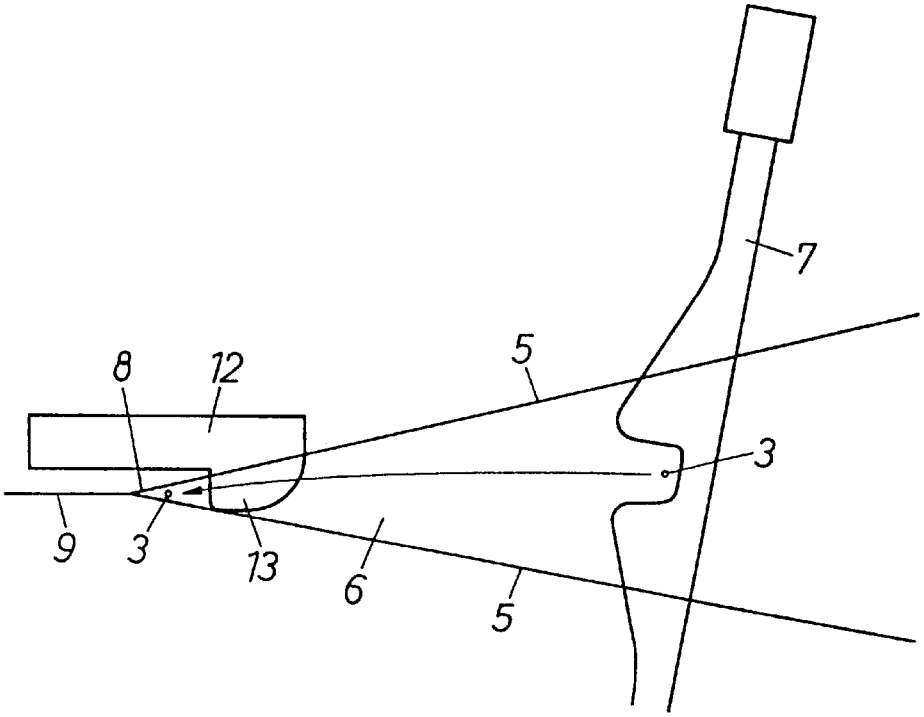
FIG. 2 is a schematic side elevation of a fringed selvage retainer incorporated into the shuttleless loom shown in FIG. 1.

Referring to FIG. 1, a shuttleless loom 1 has a picking nozzle 4 for picking a weft yarn 3 into a shed 6 formed by raising and lowering groups of warp yarns 5 and catch cords 15, respectively. The picked weft yarn 3 is properly tensioned by suction which is exerted thereon by a stretching nozzle 11, which also serves as a faulty weft yarn extracting device 14 and which is disposed on an arriving side (i.e., a side opposite the side of a picking nozzle 4) of the shuttleless loom 1 by sucking a free end of the picked weft yarn 3 into the stretching nozzle 11 so as to form a fringed selvage 10. The picked weft yarn 3 thus properly tensioned is beaten up into a cloth fell 8 with a reed 7 to weave a fabric 9. The fringed selvage 10 is held by the catch cords 15. After the picked weft yarn 3 has been beaten up into the cloth fell, the picked weft yarn 3 is cut at a position between the picking nozzle 4 and a near edge (i.e., an edge on the picking side of the shuttleless loom 1) of the cloth 9 with a yarn cutter 18. The weft yarn 3 beaten up with the reed 7 into the cloth fell 8 is interlaced with the warp yarns 5, and the free end part of the weft yam 3 extending outward from a far edge (i.e., an edge on the arriving side of the shuttleless loom 1) of the fabric 9 is held by a holding part 13 of a fringed selvage retainer 12 disposed between the far edge of the fabric 9 and the stretching nozzle 11. Thus, the fringed selvage 10 formed of the free end of the picked weft yarns 3 on the arriving side is restrained from movement to prevent the same from folding back.

The stretching nozzle 11 moves backward together with the reed 7 after a beating-up operation has been completed. Since the free end part of the picked weft yarn 3 sucked into the stretching nozzle 11 is caught by the holding part 13 of the fringed selvage retainer 12, the free end part of the picked weft yarn 3 does not come off the stretching nozzle 11. Consequently, the fringed selvage 10 is stable and the weaving operation can smoothly be continued even if the fringed selvage 10 is short.

When a mispick occurs during the weaving operation, a faulty weft yarn 3*a* needs to be extracted from the shed 6 by the faulty weft yarn extracting device 14. The fringed selvage retainer 12 is on a passage along which the faulty weft yarn 3*a* is pulled to extract the same from the shed 6 and will interfere with the faulty weft yarn 3*a*. Therefore, the fringed selvage retainer 12 must be moved away from its working position. The fringed selvage retainer 12 can be shifted between a working position where the fringed selvage retainer 12 is placed during a weaving operation, and a waiting position where the fringed selvage retainer 12 is placed during a faulty weft yarn extracting operation for extracting the faulty weft yarn 3*a*.

Figure 3:
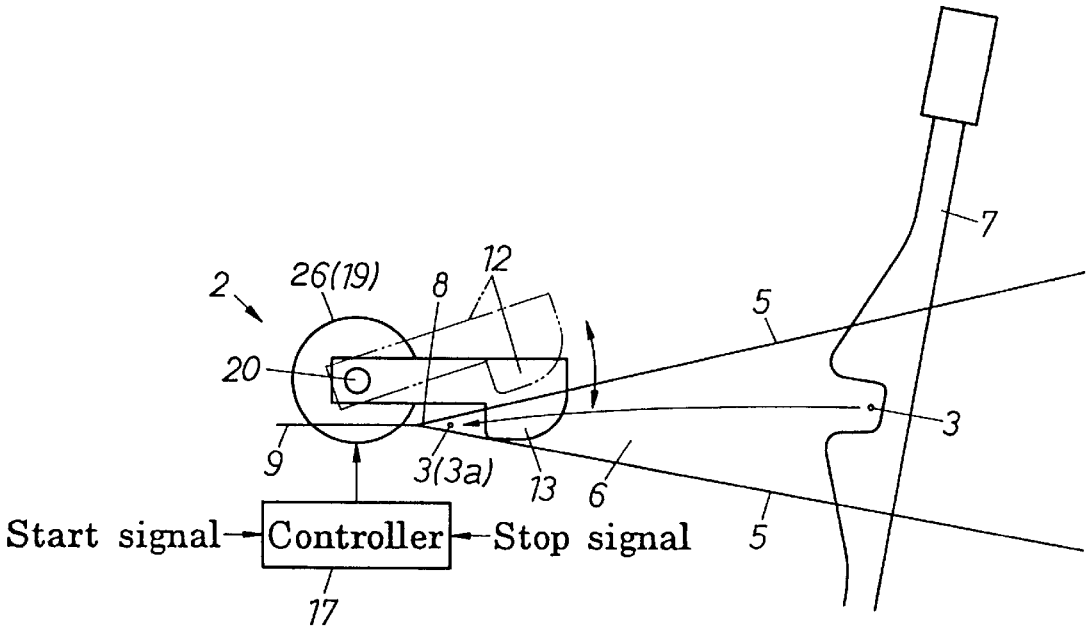
FIG. 3 is a schematic side elevation of a fringed selvage retainer operating device in a first embodiment according to the present invention incorporated into the shuttleless loom shown in FIG. 1.

FIG. 3 shows a fringed selvage retainer operating device 2 in a first embodiment according to the present invention for shifting the fringed selvage retainer 12 of the shuttleless loom 1 shown in FIG. 1 between the working position and the waiting position. This fringed selvage retainer operating device 2 comprises a disk 26 fixed to a base end part of the fringed selvage retainer 12, a rotary actuator 19, such as a servomotor, having an output shaft 20 fixed to the disk 26, and a controller 17 for controlling the rotary actuator 19.

Figure 4:
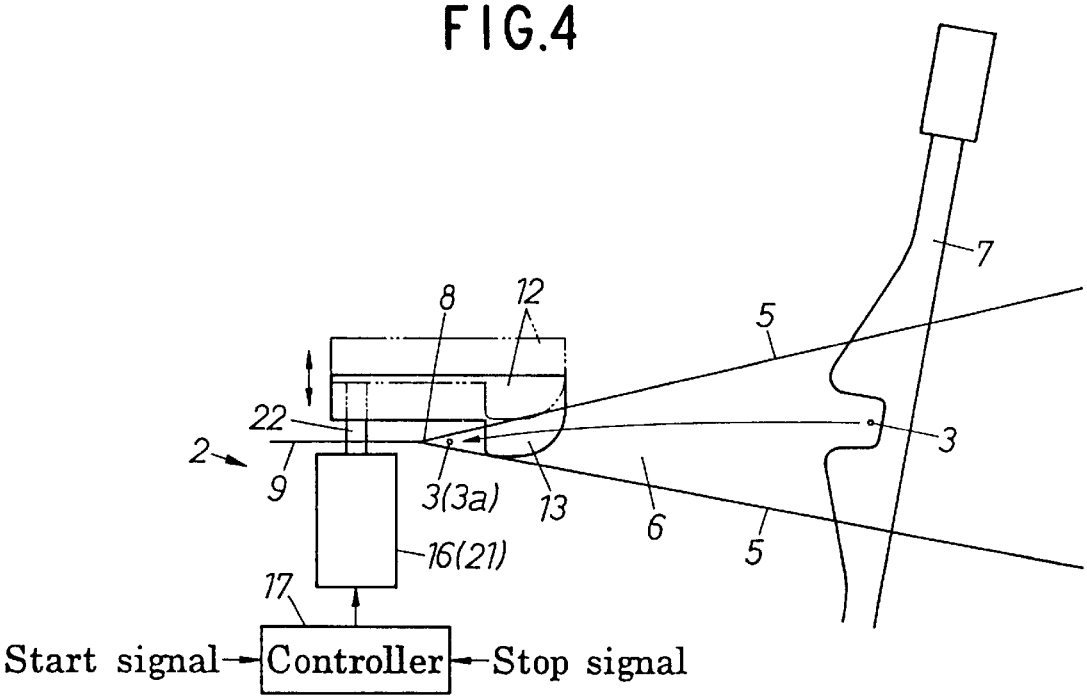
FIG. 4 is a schematic side elevation of a fringed selvage retainer operating device in a second embodiment according to the present invention incorporated into the shuttleless loom shown in FIG. 1.

The FIG. 4 shows a fringed selvage retainer operating device 2 in a second embodiment according to the present invention incorporated into a shuttleless loom 1 with substantially the same construction as that shown in FIG. 1, except that this shuttleless loom is provided with a fringed selvage retainer 12 which can be linearly moved. The fringed selvage retainer operating device 2 in the second embodiment shifts the fringed selvage retainer 12 linearly between a working position where the fringed selvage retainer 12 is placed during a weaving operation, and a waiting position where the fringed selvage retainer 12 is placed during a faulty weft yarn extracting operation. This fringed selvage retainer operating device 2 comprises a linear actuator 21, such as a solenoid actuator or a cylinder actuator, having an operating rod 22 connected to the base end part of the fringed selvage retainer 12, and a controller 17 for controlling the linear actuator 21. Although the fringed selvage retainer operating device 2 shown in FIG. 4 shifts the fringed selvage retainer 12 in a vertical direction, as viewed in FIG. 4, the fringed selvage retainer 12 may be shifted in horizontal directions or diagonal directions.

While the shuttleless loom 1 is in the normal weaving operation, a weft yarn 3 is picked by the picking nozzle 4 into a shed 6, and a free end part of the picked weft yarn 3 is held and tensioned properly by suction exerted thereon by the stretching nozzle 1 1. The picked weft yarn 3 thus properly tensioned is beaten up into a cloth fell 8 with a reed 7 to weave a fabric 9. The free end part of the weft yarn 3 extending outward from a far edge (i.e., an edge on the arriving side of the shuttleless loom 1) of the fabric 9 is retained between a holding part 13 of the fringed selvage retainer 12 and the far edge of the fabric 9. Thus, the free end part of the weft yarn 3 is prevented from folding back and a fringed selvage 10 formed of the free end parts of the picked weft yarns 3 on the arriving side is restrained from movement to prevent the same from folding back.

When a mispick occurs or an excessively large knot is found in a weft yarn 3 during the weaving operation, a stop signal is given to the shuttleless loom 1. Then, the shuttleless loom 1 operates for a braking period and stops in the next weaving cycle subsequent to a weaving cycle in which the mispick occurred or the excessively large knot was found in the weft yarn 3. A faulty weft yarn 3*a* faultily picked into the shed is not cut at a position on the picking side by a cutter 18 and remains continuous with a weft yarn 3 extending in the picking nozzle 4.

Upon the reception of a stop signal, the controller 17 drives the linear actuator 21 to shift the fringed selvage retainer 12 from the working position to the waiting position to separate the fringed selvage retainer 12 from the faulty weft yarn 3*a*. After the shuttleless loom 1 has stopped, the shuttleless loom 1 is reversed for pick finding to open a shed in which the faulty weft yarn 3*a* is inserted. Then, air is jetted through auxiliary picking nozzles 23 to separate the faulty weft yarn 3*a* from the cloth fell 8. At this stage, the free end part of the faulty weft yarn 3*a* is held by suction in the stretching nozzle 11 serving also as a faulty weft yarn extracting device 14. Subsequently, the faulty weft yarn 3*a* is cut at a position near the picking nozzle 4 with a manual cutter or a motor-driven cutter, and the faulty weft yarn 3*a* is extracted from the shed by and sucked into the stretching nozzle 11 (i.e., the faulty weft yarn extracting device 14). Since the fringed selvage retainer 12 is separated from the faulty weft yarn 3*a* and is held at the waiting position, the faulty weft yarn 3*a* extracted from the shed will not twine around or will not be caught by the fringed selvage retainer 12 and can surely be extracted.

When a start signal is given to the shuttleless loom 1 to start the shuttleless loom 1, the controller 17 controls the linear actuator 21 to shift the fringed selvage retainer 12 from the waiting position to the working position for the normal weaving operation. There is no particular restriction on the working position and the waiting position for the fringed selvage retainer 12, provided that the fringed selvage retainer 12 is able to function satisfactorily at the working position and when shifted to the waiting position, does not interfere with the faulty weft yarn 3*a* as the faulty weft yarn 3*a* is extracted.

The fringed selvage retainer operating device in accordance with the present invention may also be used in combination with any suitable weft yarn extracting device other than that shown in FIG. 1. Faulty weft yarn extracting methods which can be carried out by the shuttleless loom 1 provided with the fringed selvage retainer operating device in accordance with the present invention will be described below by way of example.

Figure 5:
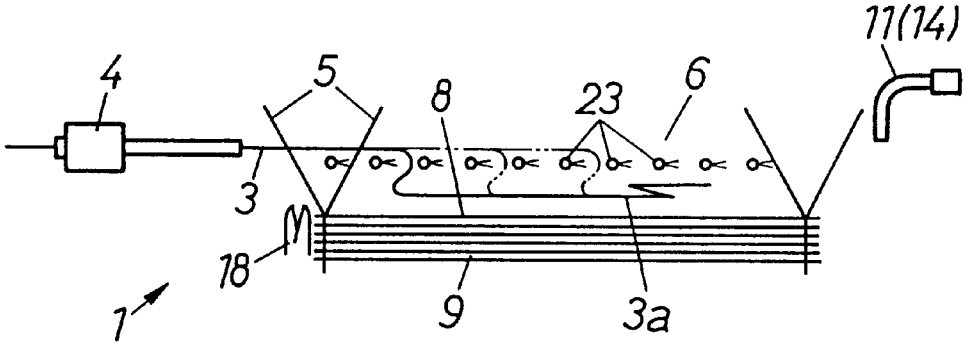
FIG. 5 is schematic plan view for explaining a method of extracting a faulty weft yarn.

FIG. 5 is a view for explaining a faulty weft yarn extracting method disclosed in Japanese Patent No. 88802 (1997). Upon the occurrence of a mispick, the shuttleless loom 1 is stopped with a faulty weft yarn 3*a* connected with a weft yarn 3 extending through the picking nozzle 4. The shuttleless loom 1 is then reversed to open a shed 6 in which the faulty weft yarn 3*a* is inserted, and a necessary length of the weft yarn 3 is fed into the shed. Air then is jetted by auxiliary picking nozzles 23 to separate the faulty weft yarn 3*a* from the cloth fell 8. The faulty weft yarn 3*a* separated from the cloth fell 8 is extracted from the shed 6 by suction exerted thereon by the stretching nozzle 11 serving also as the faulty weft yarn extracting device 14.

Figure 6:
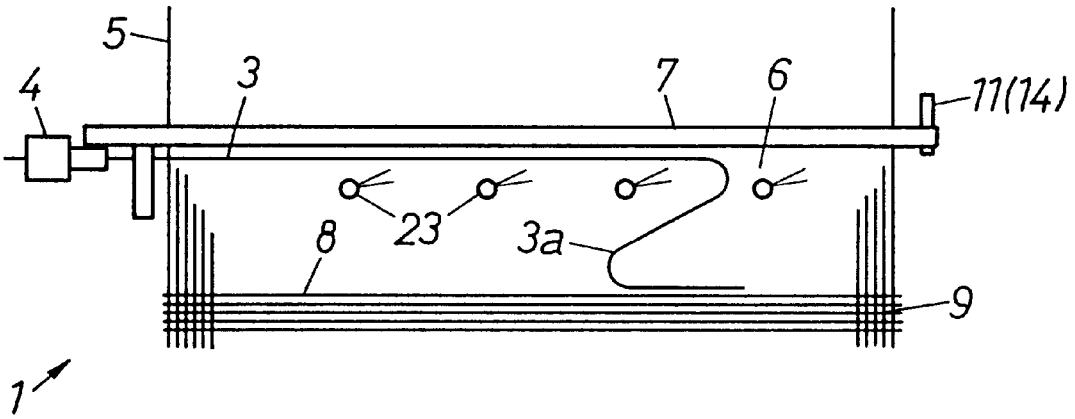
FIG. 6 is schematic plan view for explaining another method of extracting a faulty weft yarn.

FIG. 6 is a view for explaining a faulty weft yarn extracting method disclosed in JP-B No. 6-27399 or 7-12219. Upon the occurrence of a mispick, the shuttleless loom 1 is stopped with a faulty weft yarn 3*a* connected to a weft yarn 3 extending through the picking nozzle 4. The shuttleless loom 1 is then reversed to open a shed 6 in which the faulty weft yarn 3*a* is inserted, and a necessary length of the weft yarn 3 is fed into the shed 6 through the picking nozzle 4. The weft yarn 3 is pulled into the shed 6 by the suction of the stretching device 11 so that the faulty weft yarn 3*a* is bent in a U-shape, separated from the cloth fell 8 and extracted from the shed 6.

Figure 7:
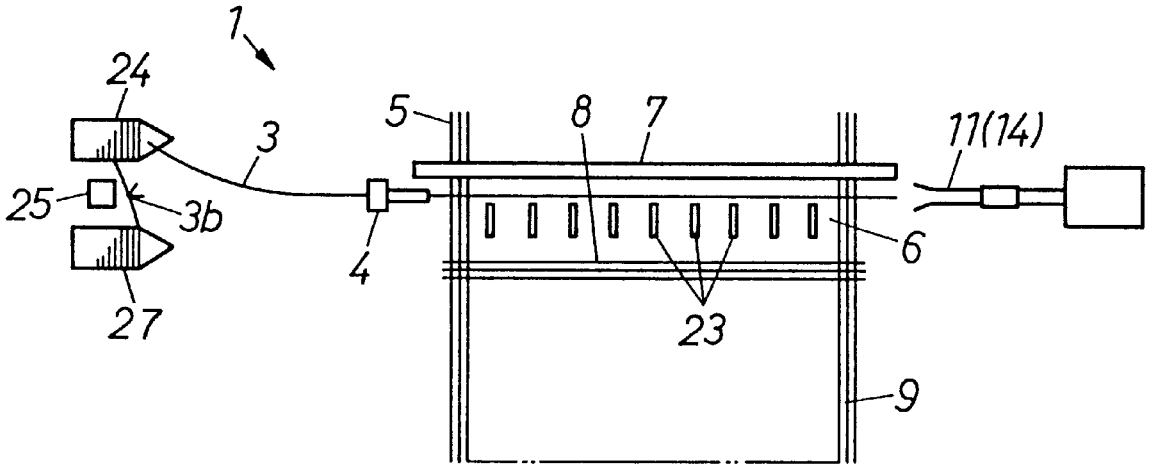
FIG. 7 is schematic plan view for explaining a third method of extracting a faulty weft yarn.

FIG. 7 is a view for explaining a faulty weft yarn extracting method disclosed in JP-B No. 60-14137. First, a weft yarn 3 wound in a first yarn package 24 is supplied, and then a weft yarn 3 wound in a second yarn package 27 and having a head end tied to the tail end of the weft yarn 3 wound in the first yarn package 24 is supplied. Upon the detection of an excessively large knot 3*b* in the weft yarn 3 by a sensor 25, the shuttleless loom 1 is stopped before the weft yarn 3 having the knot 3*b* is picked, and then air is jetted through the picking nozzle 4 to expel a part of the weft yarn 3 having the knot 3*b* from a shed toward the arriving side to avoid inserting the part of the weft yarn 3 having the knot 3*b* into the shed.

The faulty weft yarn extracting device 14 need not be a device which uses air currents to suck the free end part of the picked weft yarn 3, such as the stretching device 11. The faulty weft yarn extracting device 14 may be such as provided with a pair of gripping members that grip the free end part of the faulty weft yarn 3*a* and pull out the faulty weft yarn from the shed 6 or such as having a winding mechanism provided with a pair of gripping fingers and capable of gripping the free end part of the faulty weft yarn 3*a* by the gripping fingers and of taking up the faulty weft yarn 3*a* by winding.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. An apparatus comprising:

a shuttleless loom having an arriving side and a picking side;

a faulty weft yarn extracting device at said arriving side of said shuttleless loom for extracting a faultily picked weft yarn from a shed;

a fringed selvage retainer between said arriving side of said shuttleless loom and said faulty weft yarn extracting device, said fringed selvage retainer having a holding part for holding free ends of picked weft yarns so as to prevent the free ends of the picked weft yarns from folding back; and a fringed selvage retainer operating device including:

an actuator connected to said fringed selvage retainer and operable to shift said fringed selvage retainer between a working position whereat said fringed selvage retainer holds the free ends of picked weft yarns during a weaving operation, and a waiting position whereat said fringed selvage retainer does not hold the faultily picked weft yarn so as to prevent interference during extraction of the faultily picked weft yarn; and a controller for controlling said actuator such that said actuator shifts said fringed selvage retainer to said waiting position while the faultily picked weft yarn is being extracted by said faulty weft yarn extracting device after said shuttleless loom has been stopped.

2. The apparatus of claim 1, wherein said actuator comprises a rotary actuator having an output shaft connected to said fringed selvage retainer, said fringed selvage retainer being supported so as to be capable of rotating between said working position and said waiting position.

3. The apparatus of claim 1, wherein said actuator comprises a linear actuator having an operating rod connected to said fringed selvage retainer.

4. The apparatus of claim 1, wherein said faulty weft yarn extracting device includes a stretching nozzle component.

* * * * *